US006050605A

United States Patent [19]

Mikelionis et al.

[11] Patent Number: 6,050,605

[45] Date of Patent: Apr. 18, 2000

[54] WALLET CARD WITH SLEEVE ADAPTED FOR RECEIPT OF ELONGATED FUNCTIONAL MEMBER

[76] Inventors: Raymond J. Mikelionis, 10040 Hayes Dr., Newcastle, Calif. 95658; David Crego, 1916 Adelaide Way, San Jose, Calif. 95124

[21] Appl. No.: 08/326,669

[22] Filed: Oct. 18, 1994

Related U.S. Application Data

[63] Continuation of application No. 08/088,330, Jul. 7, 1993.

[51] Int. Cl.[7] ..... B42D 15/00

[52] U.S. Cl. ..... 283/76; 283/74; 283/103; 283/109; 283/900; 283/904

[58] Field of Search ..... 283/67, 70, 72, 283/74, 75, 76, 100, 103, 105, 107, 109, 111, 900, 901, 904

[56] References Cited

U.S. PATENT DOCUMENTS

| | | | |
|---|---|---|---|
| 3,117,608 | 1/1964 | Goss et al. | 283/76 X |
| 3,792,542 | 2/1974 | Cohan | 283/76 |
| 3,958,690 | 5/1976 | Gee, Sr. | 283/900 X |
| 4,236,332 | 12/1980 | Domo | 40/2.2 |
| 4,318,554 | 3/1982 | Anderson et al. | 283/76 |
| 4,619,469 | 10/1986 | Grover | 283/76 |
| 4,632,428 | 12/1986 | Brown | 283/900 X |
| 5,215,334 | 6/1993 | Presson et al. | 283/76 |

FOREIGN PATENT DOCUMENTS

| | | | |
|---|---|---|---|
| 220832 | 5/1968 | Switzerland | 283/76 |

*Primary Examiner*—Andrea L. Pitts
*Assistant Examiner*—Monica Smith
*Attorney, Agent, or Firm*—Joseph E. Gerber, Esq.

[57] ABSTRACT

A wallet card comprised of front and back transparent exterior surface panels, front and back core panels, and an elongate internal sleeve is disclosed. The outward-facing surfaces of the core panels bear personal medical information, and a flexible strip thermometer is stowed within the sleeve. Registering apertures are provided in the core panels, these being sized to accommodate a plurality of microfilm chips bearing further personal medical information. Thus, a display window is defined in the wallet card wherethrough the microfilm chips may be read.

7 Claims, 2 Drawing Sheets

WALLET CARD WITH SLEEVE ADAPTED FOR RECEIPT OF ELONGATED FUNCTIONAL MEMBER

This is a continuation of application Ser. No. 08/088,330 filed Jul. 7, 1993.

BACKGROUND OF THE INVENTION

1. Field of the Invention

The present invention relates generally to wallet-sized information bearing cards as might typically be carried on one's person in a wallet or purse, and it more specifically relates to such a card bearing personal medical information and able to carry a test strip within a sleeve therein.

2. Description of the Related Art

Besides cash, wallet cards are probably the most common items carried in pockets, wallets and purses. The term wallet card herein will be understood to refer to all manner of identification cards, credit cards, business cards and the like, most having a length of roughly 3½ inches and a width of roughly 2 inches. These may be constructed of card stock or cast plastic, or they may be comprised of multiple laminated stiff and/or flexible layers including any combination of paper, card stock and clear or opaque plastic. Even certain metals such as aluminum may be used in constructing some wallet cards for specialized uses. Photographs, holograms, conventionally-applied graphics, encoded magnetic strips, and text conveying personal and other information may be embedded or otherwise applied to wallet cards in ways familiar to those in the art.

However, perhaps because of their generally thin profile, wallet cards have been largely overlooked as potential receptacles for carrying other articles.

SUMMARY OF THE INVENTION

The wallet card of the present invention is adapted to fulfill a heretofore unperceived potential. As most generally claimed, the inventive wallet card includes an open-ended sleeve which is adapted to receive an elongate functional member. And, such a functional member is claimed in combination with such a card, as well.

In the preferred embodiment of the invention, the functional member is a test strip. And, even more specifically, the wallet card is a personal medical identification card and the test strip is a medical test strip. A thin, flexible thermometer is the most preferred specific embodiment.

The preferred medical information card of the invention also includes a transparent display window, within which is mounted microfilm bearing personal medical data.

Thus, it is an object of the present invention to provide a wallet card having a sleeve within which any of a great variety of elongate functional members may be stowed.

Yet another object of this invention is to provide a personal medical identification card having a medical test strip such as a thermometer conveniently stowed within a sleeve therein.

Yet a further object of the present invention is to provide a personal medical identification wallet card which includes means for bearing a higher density of personal medical information than is normally possible on a card of like size, which further includes a stowed medical test strip useful for monitoring a particular medical condition.

Still further objects of the inventive wallet card disclosed herein will be apparent from the drawings and following detailed description thereof.

DESCRIPTION OF THE PREFERRED EMBODIMENT

Figure 1:
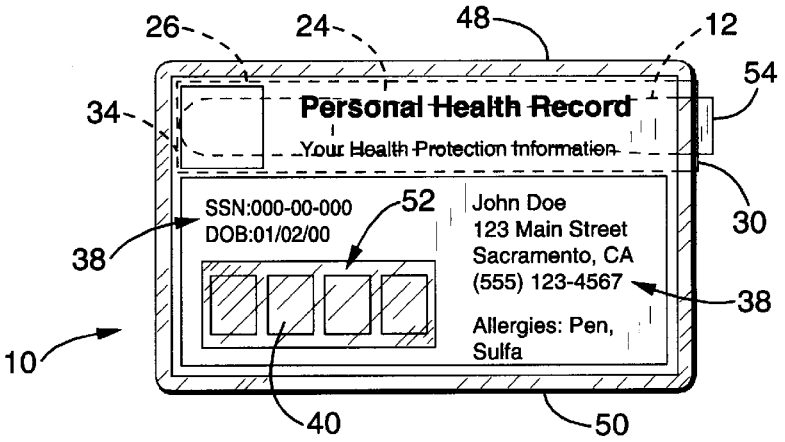
FIG. 1 is a front elevation of a personal medical identification wallet card in accordance with the invention, the card having a sleeve therein within which a thermometer strip is stowed, the sleeve and thermometer strip being shown in phantom line.
Figure 2:
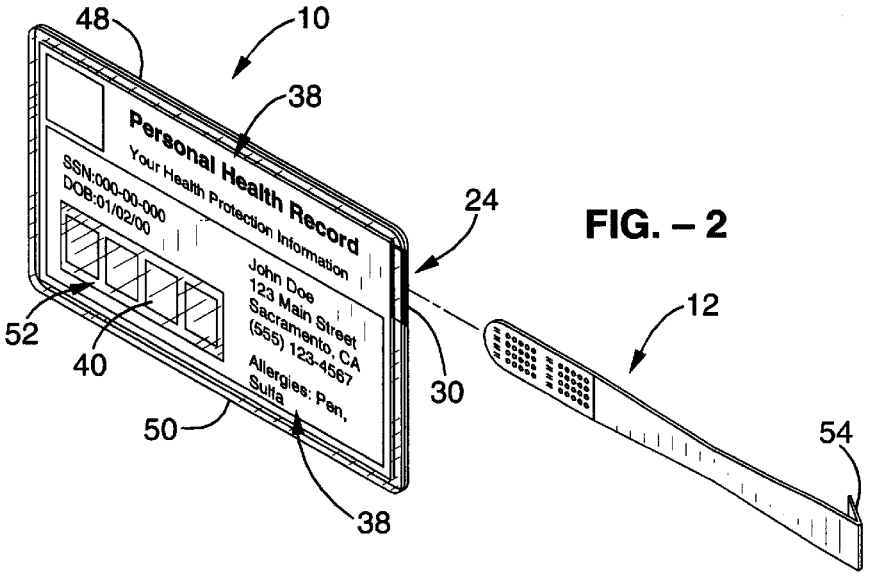
FIG. 2 shows a perspective view of the wallet card of FIG. 1 with the thermometer strip removed from within the card's sleeve.
Figure 3:
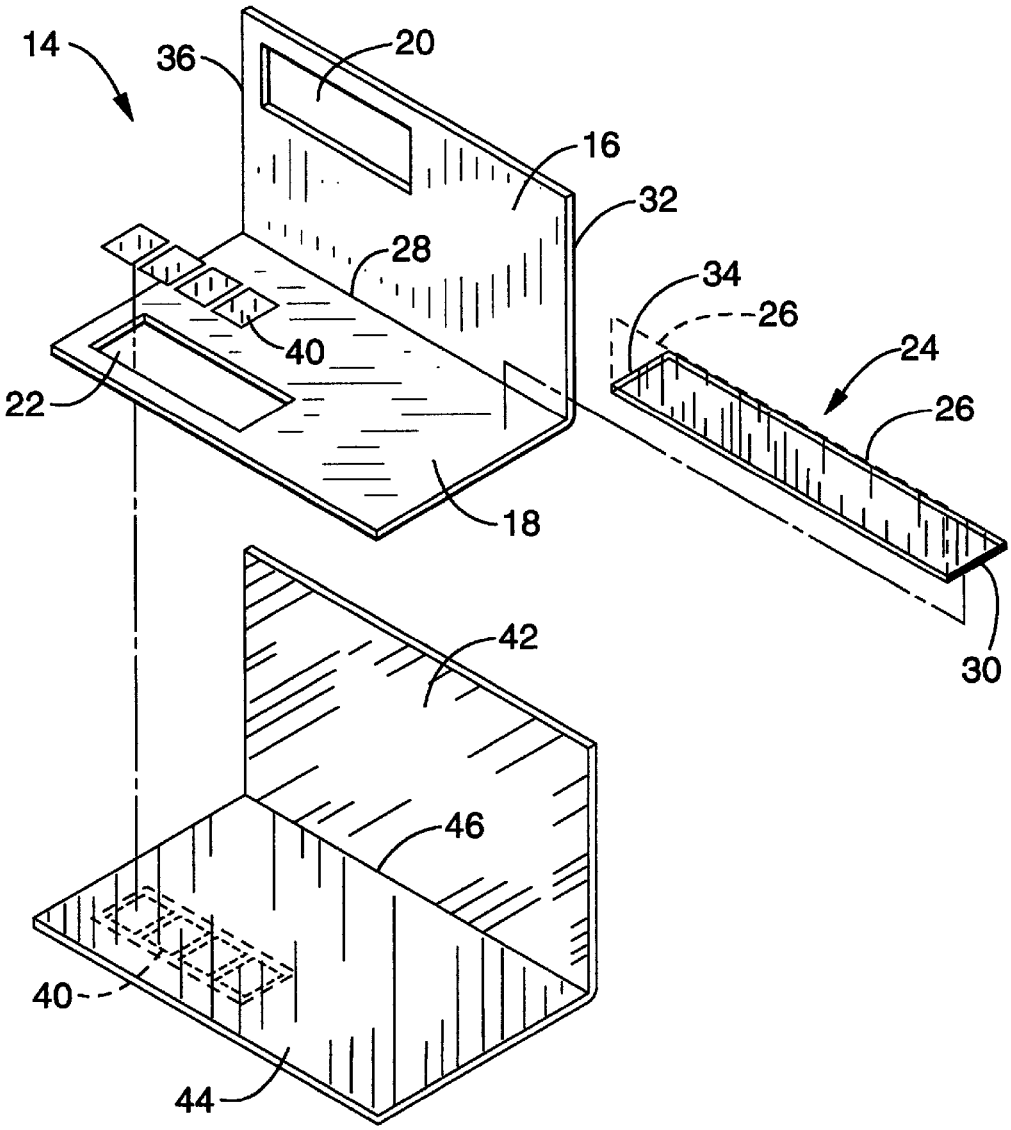
FIG. 3 is an exploded perspective view of the components from which the wallet card of FIGS. 1 and 2 is constructed. Therein phantom lines are used to illustrate the location of microfilm chips as well as to illustrate the sleeve member in an unfolded, pre-construction state. And, irregularly-dashed lead lines are used to indicate the placement of the chips and sleeve.

Referring now specifically to the drawings, FIGS. 1, 2 and 3 show the inventive wallet card which is identified generally herein with the reference numeral 10. FIGS. 1 and 2 show a fully assembled wallet card 10 along with its associated thermometer strip 12. FIG. 3 shows wallet card 10's construction.

The interior of wallet card 10 includes a core panel 14 which is folded roughly in half to define front sheet 16 and back sheet 18. Core panel 14 is preferably fashioned from durable paper or the like, but other materials may also work satisfactorily.

Identically-sized rectangular apertures 20 and 22 are provided in front and back sheets 16 and 18, respectively. Apertures 20 and 22 are positioned in their respective core sheets so that they register precisely when core panel 14 is folded.

Sleeve 24 is fashioned of a rectangular length of stock folded in half, thus bisecting it along its long axis. Sleeve 24 is placed so that its two free long edges (both identified with reference numeral 26) are nested against the inside of the fold 28 between front and back core sheets 16 and 18.

The stock used for sleeve 24 is preferably plastic, but other materials may suffice. Sleeve 24's length is preferably slightly less than the length of core panel 14 measured along fold 28. And, sleeve 24's placement is such that the end which is to be its open end 30 is flush with a first side edge 32 of core panel 14. This leaves the end which is to be sleeve 24's closed end 34 slightly short of core 14's second, or opposing, side edge 36.

The outward-facing surfaces of core panel 14 also preferably include indicia 38 comprising personal medical information. This medical information preferably complements, and is amplified by, further personal medical information printed on a plurality of microfilm chips 40 dimensioned to fit within apertures 20 and 22 in sheets 16 and 18.

The exterior of wallet card 10 includes front and back surface panels 42 and 44, respectively, which are defined by a fold 46 roughly bisecting a sheet of transparent plastic material. Transparent surface panels 42 and 44 are integrally bound into a sealing engagement with one another, with folded core panel 14, microfilm chips 40 and nested sleeve 24 being integrally sealed therebetween.

This yields a wallet card 10 having sleeve 24 oriented parallel to card 10's top and bottom edges 48 and 50, respectively. It also yields transparent display window 52 through which microfilm chips 40 can be read with the appropriate magnifying equipment. The method of sealing core 14 between surface panels 42 and 44 is well known in the art. The edges of wallet card 10 may be trimmed as necessary to yield the finished appearance illustrated in FIGS. 1 and 2.

Sleeve 24 is adapted to receive and retain any appropriately-dimensioned elongate functional member. As noted herein, to complement a personal medical information card, the preferred functional member is a flexible thermometer strip 12. Such a thermometer strip preferably includes a folded tab 54 at its end to aid in its being grasped and withdrawn from sleeve 24.

Although it is felt that a thermometer strip is an ideally-suited functional member to combine with a personal medical information card, it should be understood that other functional members may also be stowed in sleeve 24. And, functional members which complement wallet cards bearing other types of indica may also be envisioned. For example, a medical information card's sleeve may alternatively carry such test strips as pH test strips or fecal matter test strips. Thus, any medical test which can be fashioned into an appropriately-sized test strip will suffice.

The elongate functional member herein may also be an item such as a flexible magnifying glass, this perhaps being of sufficient strength for one's use in reading microfilmed information such as that borne on microfilm chips 40.

Other tools for alternative purposes may also be envisioned. For example, a person who sews textile fabric might find it useful to stow a needle threader comprising a thin handle and projecting wire loop within sleeve 24. Or, a person working on mechanical apparatus might prefer the stowed functional member to be a feeler gauge or an abrasive file as might be fashioned from either a flexible or rigid strip.

Indeed, any elongate object of an appropriate size could be carried in the inventive wallet card's multipurpose pocket. This capability makes the wallet card a particularly innovative vehicle for use as an advertising specialty. For example, a sewing products retailer might offer such a card along with several complementary sewing needles stowed in the card's sleeve. Or, a restaurant might offer a card with several toothpicks in the sleeve. Further, a plurality of sleeves may also be employed, where desired. All of these possible permutations are considered to fall within the scope of this invention.

Thus, the foregoing detailed disclosure of the inventive wallet card 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive wallet card may later be realized. Accordingly, the scope of the invention should be determined with reference to the appended claims, and not by the examples which have herein been given.

I claim:

1. A card having an open-ended sleeve therein, said sleeve being adapted to permit repeated receipt and withdrawal of a test strip, wherein said card further includes a medical test strip stowed within said sleeve.

2. A card having an open-ended sleeve therein, said sleeve being adapted to permit repeated receipt and withdrawal of a test strip, wherein said card further includes a thermometer strip stowed within said sleeve.

3. The card of claim 2, wherein said thermometer strip has a first end including temperature indicating means and a second end including means for permitting said strip to be easily grasped.

4. A card having an open-ended sleeve therein, said sleeve being adapted to permit repeated receipt and withdrawal of a test strip, wherein said card further includes a transparent display window therein.

5. A card having an open-ended sleeve therein, said sleeve being adapted to permit repeated receipt and withdrawal of a test strip, wherein microfilm bearing personal medical information is mounted within a display window.

6. A card comprising:

a. opposing front and back surfaces;

b. opposing, parallel top and bottom edges;

c. a pair of opposed, parallel side edges;

d. a core panel between said front and back surfaces, said core panel being comprised of a single sheet of core stock folded to define like front and back sheets;

e. an elongate rectangular length of stock bisected by a fold along its long axis, thus defining a folded edge opposing a pair of aligned free edges, said free edges being nested against the inside of said fold in said core stock such that a sleeve is defined; and, f. an elongate functional member stowed within said sleeve.

7. A wallet card comprising:

a. opposing, transparent front and back surface panels;

b. opposing, parallel top and bottom edges;

c. first and second opposed, parallel side edges;

d. a core panel bound between said transparent front and back surface panels, said core panel being comprised of a single sheet of core stock folded to define like front and back sheets;

e. indicia comprising personal medical information printed on an outer surface of said core panel;

f. an aperture in each of said front and back sheets of said core panel, said apertures being rectangular and of identical dimensions, said apertures being positioned in their respective core panel sheets so as to register and define a display window when said sheet of core stock is folded and bound between said transparent front and back surface panels;

g. a microfilm chip bearing personal medical information in said display window, said personal medical information corresponding to said personal information printed on said outer surface of said core panel;

h. an elongate rectangular length of stock bisected by a fold along its long axis, thus defining an elongate folded edge opposing a pair of elongate, aligned free edges, said elongate free edges being nested against the inside of said fold in said core stock such that a sleeve is defined, said sleeve being integrally bound within said card closely adjacent and parallel to said card's top edge and substantially as long as said top edge, said sleeve further including first and second ends, said first end being flush with said wallet card's first side edge and therefore being open, said sleeve's second end being adjacent to, but short of, said wallet card's second side edge and therefore being closed, said top, bottom and side edges of said opposing transparent front and back surface panels being integrally sealed, except at said sleeve's open end; and, i. a thermometer strip stowed within said sleeve, said thermometer strip having a first end including means for indicating temperature and a second end including a folded tab, said thermometer strip being stowed within said sleeve such that said temperature indicating means is adjacent said sleeve's closed end and such that said folded tab projects from said sleeve's open end to permit said thermometer strip to be grasped and withdrawn from said sleeve.

* * * * *